US009132326B2

(12) United States Patent
Caster et al.

(10) Patent No.: US 9,132,326 B2
(45) Date of Patent: Sep. 15, 2015

(54) SYSTEM FOR PROVIDING LOANER CLUBS TO NOVICE GOLFERS

(71) Applicant: TopGolf International, Inc., Dallas, TX (US)

(72) Inventors: Mark Caster, Schaumburg, IL (US); Steven Carl McCracken, San Diego, CA (US); Christopher Daniel Wagner, Chicago, IL (US); Mark Semsak, Des Plaines, IL (US); Neil John Allen, Dallas, TX (US)

(73) Assignee: Topgolf International Inc., Dallas, TX (US)

( * ) Notice: Subject to any disclaimer, the term of this patent is extended or adjusted under 35 U.S.C. 154(b) by 132 days.

(21) Appl. No.: 13/831,084

(22) Filed: Mar. 14, 2013

(65) Prior Publication Data

US 2014/0274476 A1 Sep. 18, 2014

(51) Int. Cl.

| | |
|---|---|
| ***A63B 55/10*** | (2006.01) |
| *A63B 53/00* | (2015.01) |
| *A63B 71/06* | (2006.01) |

(52) U.S. Cl.

CPC ..... *A63B 55/10* (2013.01); *A63B 2053/005* (2013.01); *A63B 2071/0694* (2013.01)

(58) Field of Classification Search

CPC ..... A63B 55/10; A63B 2071/0694; A63B 2053/005

USPC ..... 473/150, 168, 282; 206/315.2–315.8; 211/70.2; D21/796; D6/552

See application file for complete search history.

(56) References Cited

U.S. PATENT DOCUMENTS

| | | | | |
|---|---|---|---|---|
| 3,394,817 | A * | 7/1968 | Stembol et al. | 211/70.2 |
| 5,127,530 | A | 7/1992 | Ortuno | |
| 5,492,230 | A | 2/1996 | Horton | |
| 5,538,769 | A * | 7/1996 | Sandman, Jr. | 428/36.3 |
| 5,564,988 | A * | 10/1996 | Brooks | 473/150 |
| 5,586,942 | A * | 12/1996 | Wittek al. | 473/168 |
| 6,179,256 | B1 | 1/2001 | Utterback | |
| 6,341,690 | B1 * | 1/2002 | Swiatosz | 206/315.6 |
| 6,607,123 | B1 * | 8/2003 | Jollifee et al. | 235/375 |
| 6,884,178 | B1 * | 4/2005 | Frost | 473/150 |
| 6,955,609 | B1 | 10/2005 | Hiltner, Jr. et al. | |

(Continued)

FOREIGN PATENT DOCUMENTS

| | | | | |
|---|---|---|---|---|
| JP | 2003190349 | * | 7/2003 | |
| JP | 2003190349 | A * | 7/2003 | A63B 69/36 |

OTHER PUBLICATIONS

Golf Club Distances; about.com; http://golf.about.com/od/beginners/l/blclubdistance.htm; Feb. 13, 2013; 3 pages.

(Continued)

*Primary Examiner* — Stephen Blau
(74) *Attorney, Agent, or Firm* — Fish & Richardson P.C.

(57) ABSTRACT

A system for providing loaner clubs to novice golfers includes a coding scheme for golf club holders, which can be provided at a golf range having targets, in order to facilitate play by people entirely new to the game of golf. In general, one innovative aspect of the subject matter described in this specification can include a golf club stand including holders for golf clubs of different types, and visual indicators associated with the holders for the golf clubs of different types, where the visual indicators correspond to targets of different distances within a golf range.

11 Claims, 5 Drawing Sheets

(56) References Cited

U.S. PATENT DOCUMENTS

| | | | | |
|---|---|---|---|---|
| 7,056,221 | B2 * | 6/2006 | Thirkettle et al. | 473/168 |
| 7,059,974 | B1 | 6/2006 | Golliffe et al. | |
| 7,160,196 | B2 | 1/2007 | Thirkettle et al. | |
| 7,337,965 | B2 | 3/2008 | Thirkettle et al. | |
| 7,677,989 | B2 | 3/2010 | Fletcher | |
| 8,025,589 | B2 * | 9/2011 | Brinton et al. | 473/290 |
| 8,235,832 | B2 * | 8/2012 | Burnett et al. | 473/290 |
| D686,020 | S * | 7/2013 | Nenadovich | D6/552 |
| 8,678,954 | B2 * | 3/2014 | Anton | 473/409 |
| 2004/0259657 | A1 * | 12/2004 | Heller et al. | 473/287 |
| 2005/0072696 | A1 | 4/2005 | Yang | |
| 2005/0072697 | A1 | 4/2005 | Yang | |
| 2014/0243114 | A1 * | 8/2014 | Marlow | 473/409 |

OTHER PUBLICATIONS

Golf Club Comparison Chart: Loft and Distance; Aubuchon, Vaughn; http://www.vaughns-1-pagers.com/sports/golf-club-data.htm; Feb. 13, 2013; last update Jun. 15, 2013; 3 pages.

How to know which golf club to use; For Dummies; http://www.dummies.com/how-to/content/how-to-know-which-golf-club-to-use.html; Feb. 13, 2013; 3 pages.

Focus on Stroke Length, Tempo to Control Distance on Putts; GLENNCGRAY; About.com; http://golf.about.com/u/sty/golftips/putting-instruction/Focus-on-Stroke-Length-Tempo-to-Control-Distance-on-Putts.htm; Feb. 13, 2013; 3 pages.

The Mizuno Golf Club Display; Nashville Display; Creative Wire & Metal Displays; http://www.creativemag.com/wm703.html; Jun./Jul. 2003; Mar. 12, 2013; 9 pages.

Aerial photo of TopGolf, Alexandria; TopGolf; http://topgolf.com/locations/; Feb. 14, 2013; 1 pages.

Frequently Asked Questions—Top Golf; TopGolf; http://topgolf.com/company/faq/; Feb. 13, 2013; copyright 2012; 6 pages.

Photo of Allen, TX TopGolf site—Bay with Bag Holder; TopGolf; http://topgolf.com/assets/gallery/11/268.jpg ; Mar. 11, 2013; 1 page.

Photo of Allen, TX TopGolf site—Bay with Bag Holder; TopGolf; http://topgolf.com/assets/gallery/11/267.jpg; Mar. 11, 2013; 1 page.

TopGolf; Wikipedia; http://en.wikipedia.org/wiki/TopGolf; Feb 13, 2013; last modified Dec. 19, 2012; 3 pages.

* cited by examiner

SYSTEM FOR PROVIDING LOANER CLUBS TO NOVICE GOLFERS

BACKGROUND

This specification relates to golf, golf clubs, and holders for golf clubs in a golf club stand, The origins of golf are not clear, but the modern game of golf is generally considered to have begun in Scotland during the Middle Ages. Golf began to find substantial international popularity beginning in the late nineteenth and early twentieth centuries, and more specifically in the United States during the roaring twenties. Even so, golf remains widely viewed as a game of the upper classes, requiring a good deal of money and time to play. Because of the time needed to play a full game of golf, driving ranges are often used by golfers to practice their swing when they do not have the time for eighteen holes of golf. However, hitting golf balls at a driving range has often been considered a rather boring pastime, even when targets are provided on the golf range.

More recently, however, this notion has changed with the development of interactive golf ranges, where the successful hitting of a target with a golf ball is automatically identified in a computer system. For example, the TopGolf company has developed Radio Frequency Identification (RFID) technology for golf balls and targets that enables rapid feedback for golf balls hit by specific players into specific targets on a golf range. Details of RFID and other golf related technologies can be found in U.S. Pat. Nos. 6,607,123, 7,056,221, 7,059,974, 7,160,196, and 7,337,965, which are hereby incorporated by reference. Such technologies allow the development of innovative and exciting games of golf that increase the fun for new players while still providing an authentic golf experience for established players. These exciting games, along with golf range facilities that include high quality food and drink, and other on-site entertainments, open the doors to a much larger public interested in playing golf.

SUMMARY

A system for providing loaner clubs to novice golfers includes a coding scheme for golf club holders, which can be provided at a golf range having targets, in order to facilitate play by people entirely new to the game of golf. For example, a golf club stand can include one portion for holding traditional golf club bags brought by established players, and another portion for holding freely available clubs for use by new players who do not own golf clubs of their own. The portion of the golf club stand that holds the freely available clubs can include visual indicators, such as colors, that correspond to targets of different distances within the golf range. This can provide significant advantages for new players that may have very little knowledge of the game of golf, who would otherwise have no idea how to select a club for a particular game of targeted golf currently being played. Other advantages of various embodiments of the present invention can also be realized. For example, the total time needed for new players to complete a game can be reduced, and the total cost of golf club stands can also be reduced.

In general, one innovative aspect of the subject matter described in this specification can include a golf club stand including holders for golf clubs of different types, and visual indicators associated with the holders for the golf clubs of different types, where the visual indicators correspond to targets of different distances within a golf range. Each of the holders for the golf clubs of different types can have more than one of the visual indicators associated therewith.

The visual indicators can be colors that match colors associated with the different targets. The golf club stand can include a panel including discrete sections, each of the discrete sections including a color and a distance value corresponding to one of the different targets. The holders golf club stand can include holes in the panel, and each of the holders can have three different colors associated therewith, thereby indicating three different targets for a club in the holder.

The golf club stand can include a first portion and a second portion, where the first portion includes the holders and the visual indicators, and the second portion includes openings for golf club bags. The second portion can include an angled base and a stop for each of the openings for golf club bags.

According to another innovative aspect of the subject matter described in this specification, a system can include a golf ball hitting bay, and a golf range in front of the bay, where the range includes targets having different distances from the bay, and each of the different targets has an associated identifier. The system can include a device in the bay, wherein the device delivers golf balls retrieved from the different targets, and also include a golf club stand associated with the bay, wherein the golf club stand holds clubs of different types and includes visual indicators corresponding to the different targets. The golf ball hitting bay can be a first bay that includes at least part of the golf club stand, and the system can include a second bay that includes at least part of the same golf club stand. The golf club stand can have two sides, each of the sides holding clubs and including visual indicators corresponding to the different targets, where the first and second bays share the golf club stand.

The golf range can include additional targets having similar distances from the bay as the targets having different distances from the bay. The different targets can include circular targets, or other shaped targets. The golf club stand cam include discrete portions for the different types of golf clubs, where each of the discrete portions has more than one of the visual indicators associated therewith. Moreover, the identifiers and the visual indicators can be colors, and the golf club stand can include a panel including discrete sections, each of the discrete sections including a color and a distance value corresponding to one of the different targets. The discrete portions for the different types of golf clubs can be holes in the panel. The discrete portions can each have three different colors associated therewith and be in either a men portion or a ladies portion of the panel.

The golf club stand can include a first portion and a second portion, where the second portion includes openings for golf club bags, such as noted above. Moreover, the system can include the clubs of different types, wherein at least the drivers, "woods" and hybrids are configured to be more durable than golf clubs sold at retail outlets.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
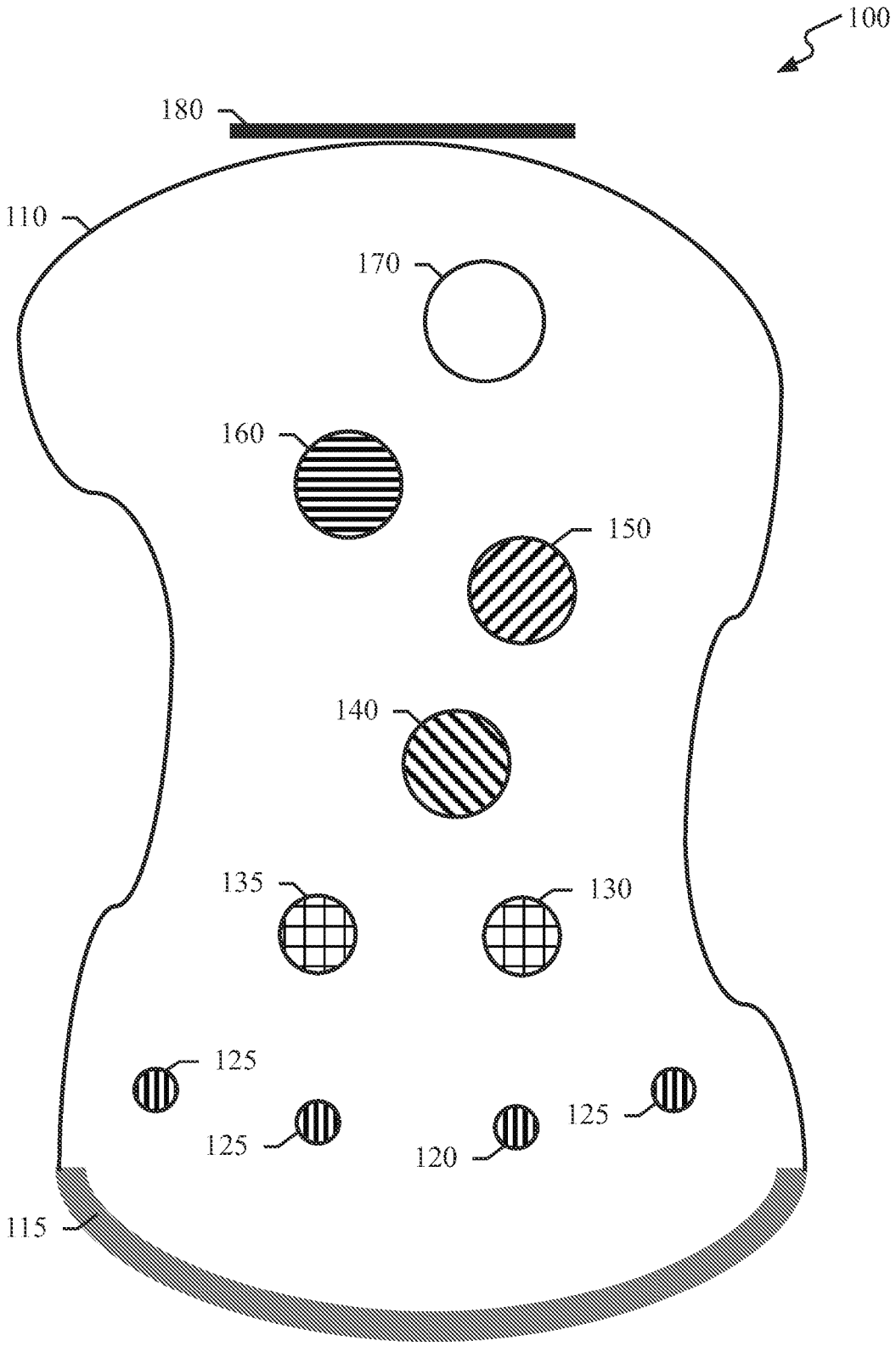
FIG. 1 shows an example of a golfing site.

FIG. 1 shows an example of a golfing site 100. The golfing site 100 includes a golf range 110 and building 115. The golf range 100 can be of various shapes and sizes, but will typically be 300-500 feet wide and 600-900 feet long. The golf range can be flat or include small hills or one or more inclines, and can also include hazards, such as water and sand traps. Note that such hazards may not include actual water and sand, but may simply be colored to look like water or sand. Moreover, the golf range 100 can be composed of real grass or artificial turf.

Included in the golf range 100 are targets 120, 130, 140, 150, 160, 170, 180 having different distances from the building 115, where people stand to hit golf balls toward the targets. As shown, additional targets 125, 135 can be provided that have similar distances from the building 115 as the other targets 120, 130, 140, 150, 160, 170, 180. The distances will not be exactly equal, due to small variations in placement of the targets for any given site, and due to the variation in distance caused by the specific location of a golfer in the building 115. Nonetheless, the targets will be grouped into distance categories that generally represent their distance from the building 115 and thus the difficulty of hitting targets in that category from any given bay in the building 115. As will be appreciated, various numbers of targets can be provided in each of these distance categories. Moreover, the targets can be circular or have other shapes, such as a rectangular trench target 180.

Each of the targets 120-180 can include a mechanism for identifying and collecting the golf balls that enter the target. For example, each target can include netting that funnels the golf balls into an RFID reader box, where RFID tags inside the balls are read as each ball passes through the box. Each reader box can be equipped with an RFID antenna that is connected with an RFID reader, which in turn is connected with a computer system for the golfing site 100 that manages the golf games. Moreover, one or more of the targets 120-180 can include discrete sections of nets such that information regarding which portion of the target a particular golf ball lands in can be determined, and different points or game features can be applied accordingly. Each such net section can have its own reader box and RFID antenna, and multiple such antennas can be multiplexed into a single RFID reader to reduce the total number of RFID readers needed for the golfing site 100.

Once the golf balls are read and collected in a common location within each target, they can be manually or automatically returned to the building 115 for another hit. For example, each target can include a collection point that includes a helical screw to capture and direct the golf balls to a vacuum intake point where the golf balls can be individually sucked through pneumatic tubes back to the building 115. Moreover, the golf balls can be individually washed and read again by an additional RFID reader at the building 115 before being placed back into play.

Each of the different targets 120, 130, 140, 150, 160, 170, 180 also has an associated identifier, which can be seen from the building 115 by the golf players. These identifiers should be readily apparent, and can include colors, patterns, alphanumeric characters, or other types of characters that are readily identifiable (e.g., images of well-known celebrities or cartoon characters). For example, the identifiers for the targets can be different colors, as shown in FIG. 1, where target 120 is red, target 130 is yellow, target 140 is green, target 150 is brown, target 160 is blue, target 170 is white, and target 180 is black. As shown, other targets in the same distance category can be assigned the same color. Moreover, in some implementations, other colors can be assigned, as well as other types of identifiers.

The identifiers can be located prominently near the targets 120-180 or be integrated with the targets. For example, in some implementations, the netting in the targets 120-180 have the corresponding colors, and lighting in the targets 120-180 also provide the corresponding colors for game play at night.

Figure 2A:
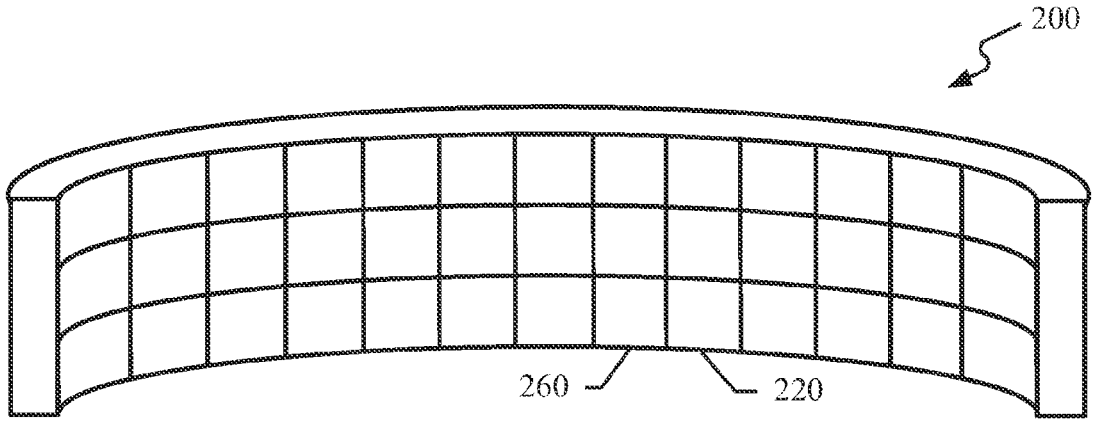
FIG. 2A shows an example of a building for a golfing site.

FIG. 2A shows an example of a building 200 for a golfing site. The building 200 can be an example of the building 115 from FIG. 1, and is shown from the perspective of the golf range looking back at the building. As shown, the building 200 can include three tiers of golf hitting bays, including golf bays 220, 260. The golf bays are open to the golf range, and can include heating and misting elements for cold and hot days, respectively. The building 200 can also include enclosed portions for other site facilities, such as a restaurant, bar, billiards room, etc.

Each of the golf bays in the building 200 can be the same, or there can be different levels of accommodation for different types of golf bays. The golf bays on the first level, such as golf bays 220 and 260, can have direct access to the golf range, whereas golf bays on higher tiers will typically have safety netting extending horizontally away from the building 200 to prevent injury should someone accidentally fall out of the front of the bay. In addition, each golf bay can include one or more tee off locations.

Figure 2B:
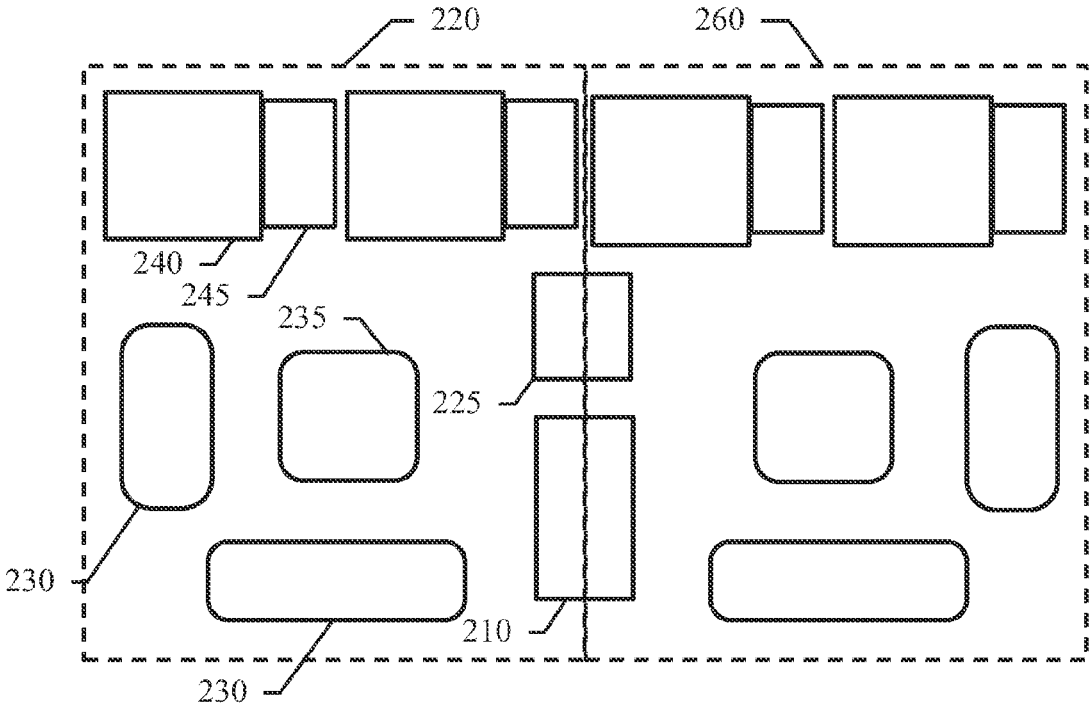
FIG. 2B shows an example of a layout for two golf ball hitting bays.

FIG. 2B shows an example of a layout for two golf ball hitting bays 220, 260. The golf bay 220 can include seating 230 and a table 235 to facilitate dining and conversation during the game. The golf bay 260 can also include such seating and table areas, which can be a mirror image of that provided in bay 220, or not. Moreover, each of the bays 220, 260 can include two tee off locations, where each tee off location includes a tee area 240 and a device 245 for golf ball delivery. The device 245 can be directly connected with a pneumatic tube system, such that golf balls can be automatically retrieved from the targets and fed back to the players without human intervention. Alternatively, the golf balls can be collected from a central location in the building 200 and manually dropped into a container associated with each device 245.

The two bays 220, 260 can share a golf club stand 210, which is described in further detail below, and an electronic hub 225. The electronic hub 225 can include various power lines and cables to support separate televisions and computer terminals for each bay 220, 260. Each computer terminal can be a touch screen device that connects with the central computer system for the building 200 and provides the players with direct control over their game play, including selecting the type of game to play and the current player.

The device 245 can include a proximity sensor, a light emitting diode (LED), an RFID reader, a ball release mechanism, and electronics to control all of these together. Thus, a current player stepping into the tee off area 240 can waive a golf club in front of the proximity sensor, which triggers the release mechanism and the LED (to alert the player that the golf ball is coming). The golf ball is then released from a container and passes through a tube to be read by the RFID reader, thereby associating that specific golf ball with the current player and that player's location, before being output to the tee area 240.

Although FIG. 2B shows only a single electronic hub 225 and a single golf club stand 210, it will be appreciated that other configurations are possible. For example, each pair of bays in the building can share a golf club stand and an electronic hub. Thus, the bay 220 can have an electronic hub on each side of the bay, and a group of people can play two separate games using the two separate computer terminals and the two separate tee off areas, all while enjoying each other's company in the same golf bay. Alternatively, the seating and table areas can be split up such that each bay can host two separate groups.

Figure 3A:
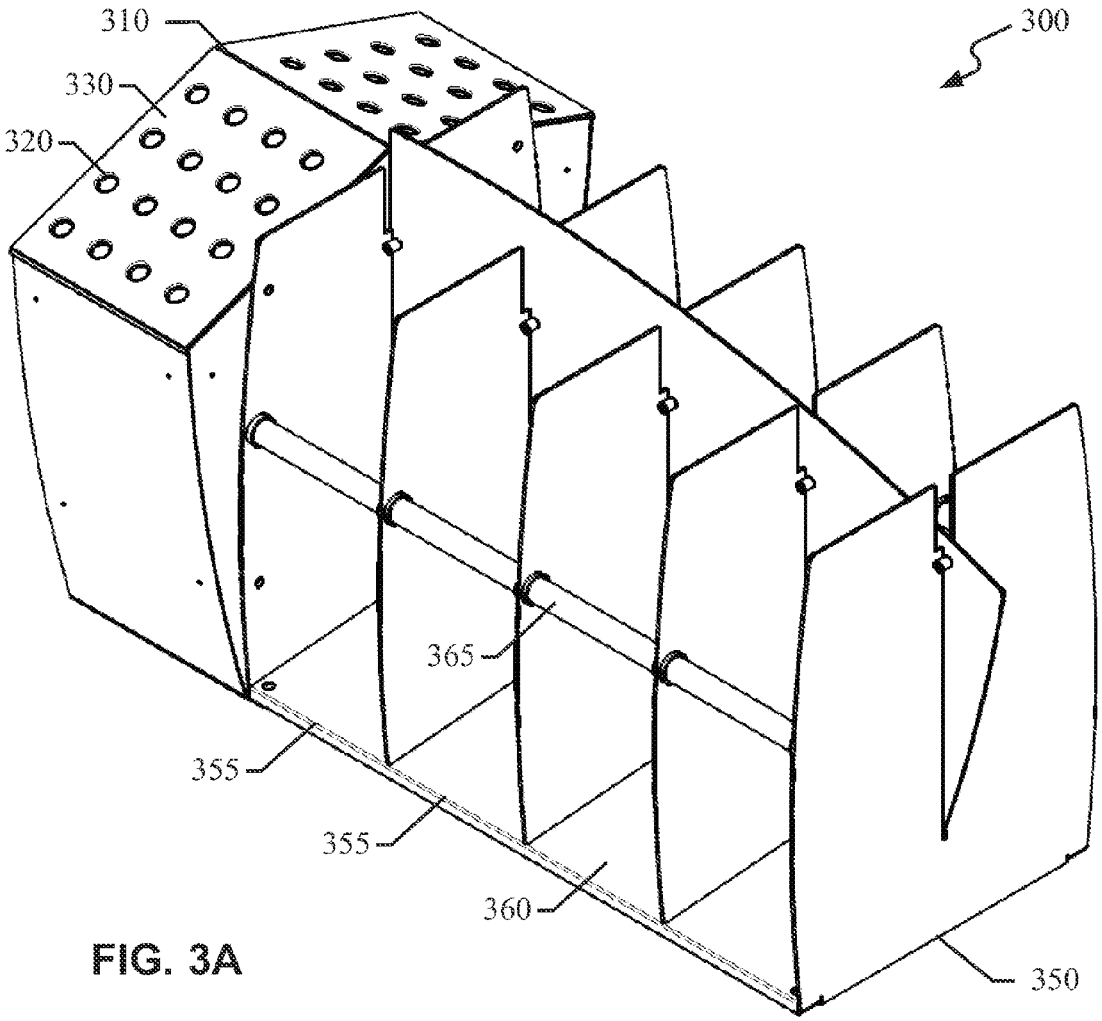
FIGS. 3A, 3C, 3D, & 3E show an example of a golf club stand.

FIG. 3A shows a perspective view of an example of a golf club stand 300. The golf club stand 300 includes a first portion 310 and a second portion 350. As shown, these two portions of the golf club stand 300 can each have two sides that are near mirror images of each other, where each side is used by a respective bay of two bays that share the golf club stand 300. The two sides are the mirror of each other with the exception of the positioning of the holes 320 in the panels 330, which are offset to make room for a ranging chart, which is discussed further below. In some implementations, the two sides are exact mirror images of each other. In other implementations, the golf club stand 300 need only be one sided. Moreover, in some implementations, the golf club stand 300 need only include the first portion 310, and can exclude the second portion 350.

The second portion 350 can include openings 355 for golf club bags. Each opening 355 can include an angled base 360 and a stop 365. For example, the angled base 360 can be a flat surface placed at an angle between five and thirty degrees (inclusive) with respect to the ground to cause a golf club bag to tip outward from the golf club stand 300 to facilitate access to the established player's own clubs. In some implementations, the angle is at or about (plus or minus 0.4 degrees) 5 degrees. This angle helps to guarantee that the average bag stored in the bag stand will tilt outwards enough to facilitate club access without being prone to falling out or taking up too much space. Alternatively, each opening 355 can include a hook or a bar from which the golf club bag is hung by a strap or handle on the bag. In such implementations, the 5 degree angle can also be used, governed by the typical length of a golf club bag in comparison with the length between the attachment mechanism for the top of the bag and the stop against which the bottom of the bag would rest.

Figure 3B:
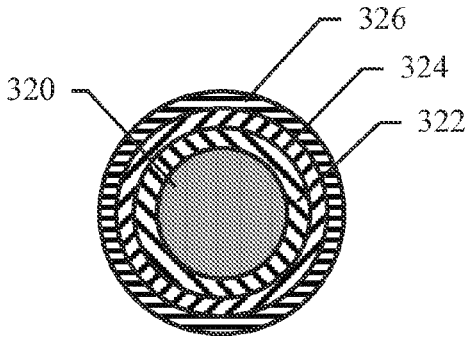
FIG. 3B shows an example of visual indicators for a holder of a golf club stand.
Figure 3C:
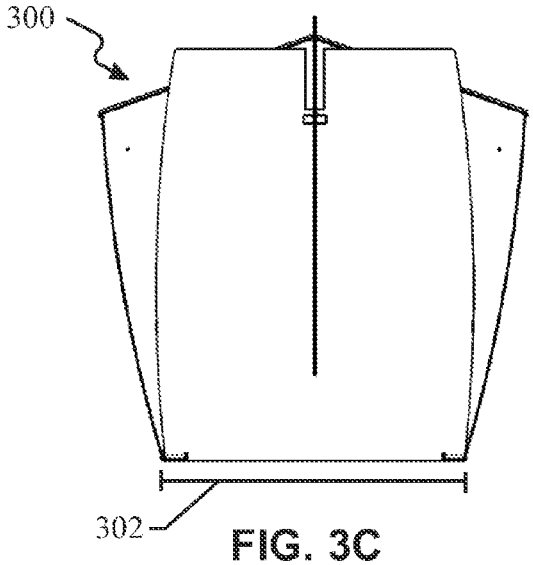
Figure 3D:
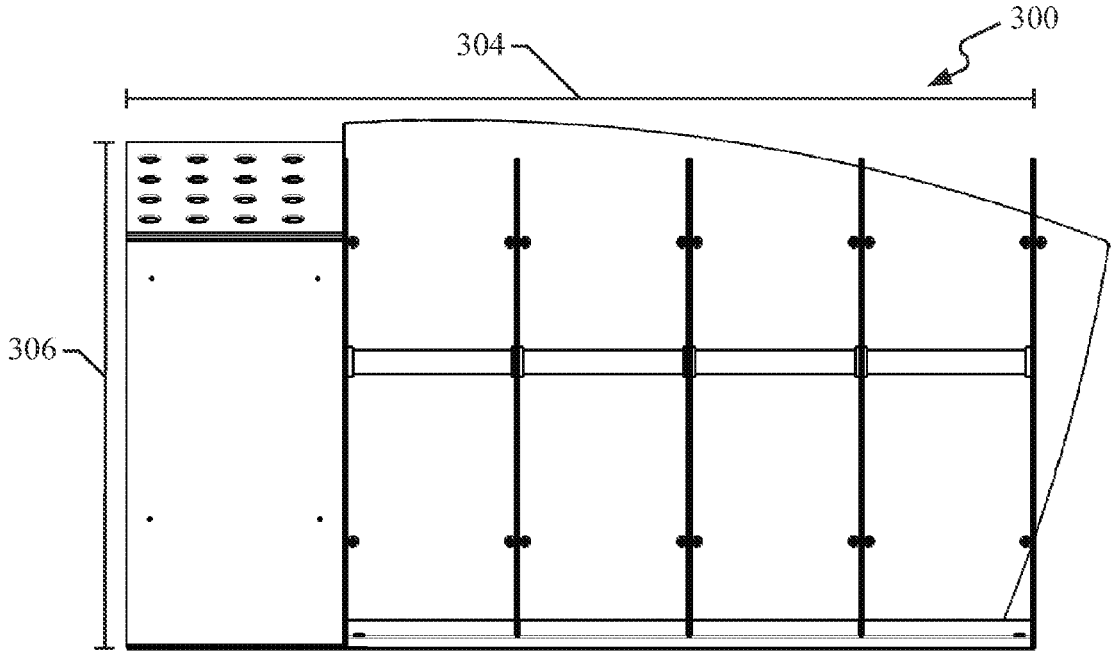
Figure 3E:
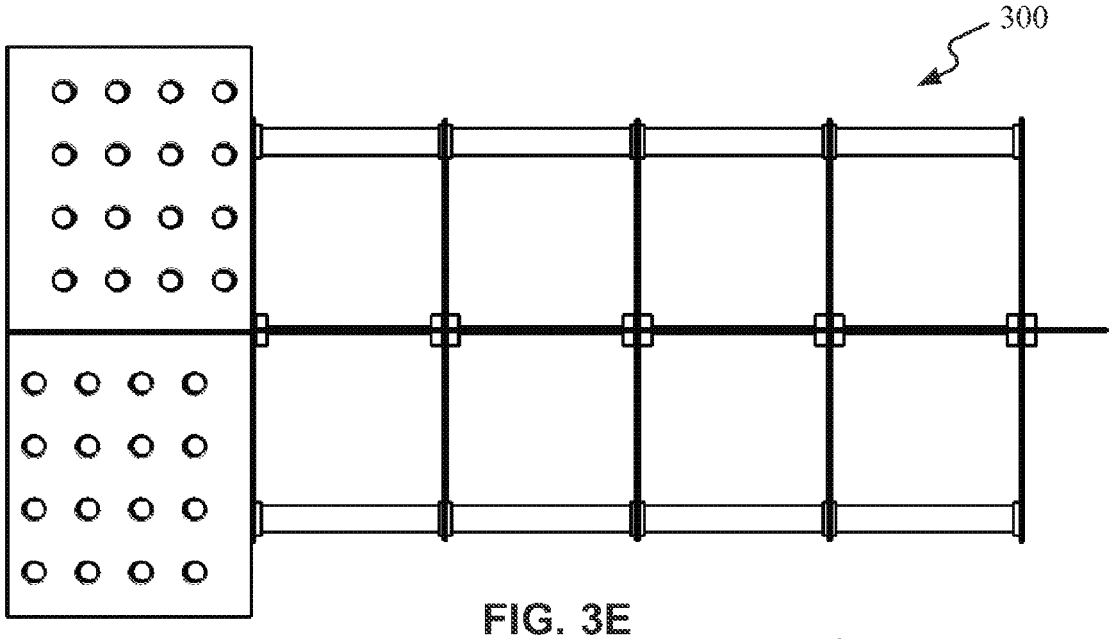

The stop 365 can be a crossbar, as shown, that prevents the golf club bag from tipping out of the golf club stand 300 entirely. Other types of stops are possible. In this example golf club stand 300, the crossbar 365 is placed at or about (plus or minus 0.4 inches) twenty three inches from the angled base. This height can assist in preventing the golf club bag from tipping out of the golf club stand 300 without imposing an undue restriction or obstacle when placing the golf club bag in the golf club stand 300. For implementations with this dimension, FIG. 3C shows a front view of the golf club stand 300, where with width 302 at the base is 31.1 inches. FIG. 3D shows a side view of this same example golf club stand 300, where with length 304 is 76.0 inches, and the height 306 is 42.4 inches. FIG. 3E shows a top view of this same example golf club stand 300.

The first portion 310 of the golf club stand 300 can include discrete portions for holding different types of golf clubs that are made freely available to players who may not have their own clubs, i.e., leaner clubs. For example, the discrete portions can include holes 320 in a panel 330. These holes 320 can be openings into an empty interior of the first portion 310 of the golf club stand 300, which thus form holders for clubs when they are placed therein, grip side first. Alternatively, there can be internal structure for the first portion 310 of the golf club stand 300 that helps keep the golf clubs in position when placed in the holders. For example, each hole 320 can be an opening to a tube (e.g., a PVC pipe with an inner diameter of 1.5 inches) that holds the shaft of the club at a consistent angle relative to the ground.

In addition, if the first portion 310 of the golf club stand 300 is taller than the golf clubs, an additional base can be included, which is higher than the bottom of the golf club stand 300, such that the grip of each club comes to a rest thereon (within the interior of the first portion 310) so that the club is not supported by its head resting on the panel 330. Alternatively, the first portion 310 of the golf club stand 300 can be much shorter than the golf clubs, such that less than half of each club shaft or handle is held within the first portion 310. Further, in some implementations, the first portion 310 need not include sides, but rather can be made of two arrays of aligned rings through which the club handles and/or shafts pass for holding in position.

The materials used to construct the golf club stand 300 can include cold rolled steel of various gauges, with a powder coat protective finish. The golf club stand 300 can be assembled using threaded fasteners. This can facilitate on-site assembly, which can reduce shipping expenditures when deploying many sites per year. In some implementations, other materials can be used, such as aluminum and stainless steel. Moreover, in some implementations, the assembly can be welded, or the golf club stand 300 can be made out of plastics.

Each of the holes 320 has at least one visual indicator placed nearby that corresponds to the indicator for a target on the golf range. For instance, FIG. 3B shows an example of visual indicators 322, 324, 326 for a hole 320 in the golf club stand 300. As shown, the visual indicators are green 322, brown 324, and blue 326. Thus, in the example golfing site of FIG. 1, this holder would be used for a 6 Iron or an 8 Iron, or possibly a 4 Iron for women. Various possible arrangements of club types with target distances can be used, while still solving the general problem of quickly identifying appropriate club types for novice golfers that are playing a targeted golf game. In addition, a ranging chart can also be provided on the golf club stand 300 to facilitate quick club selection.

Figure 4:
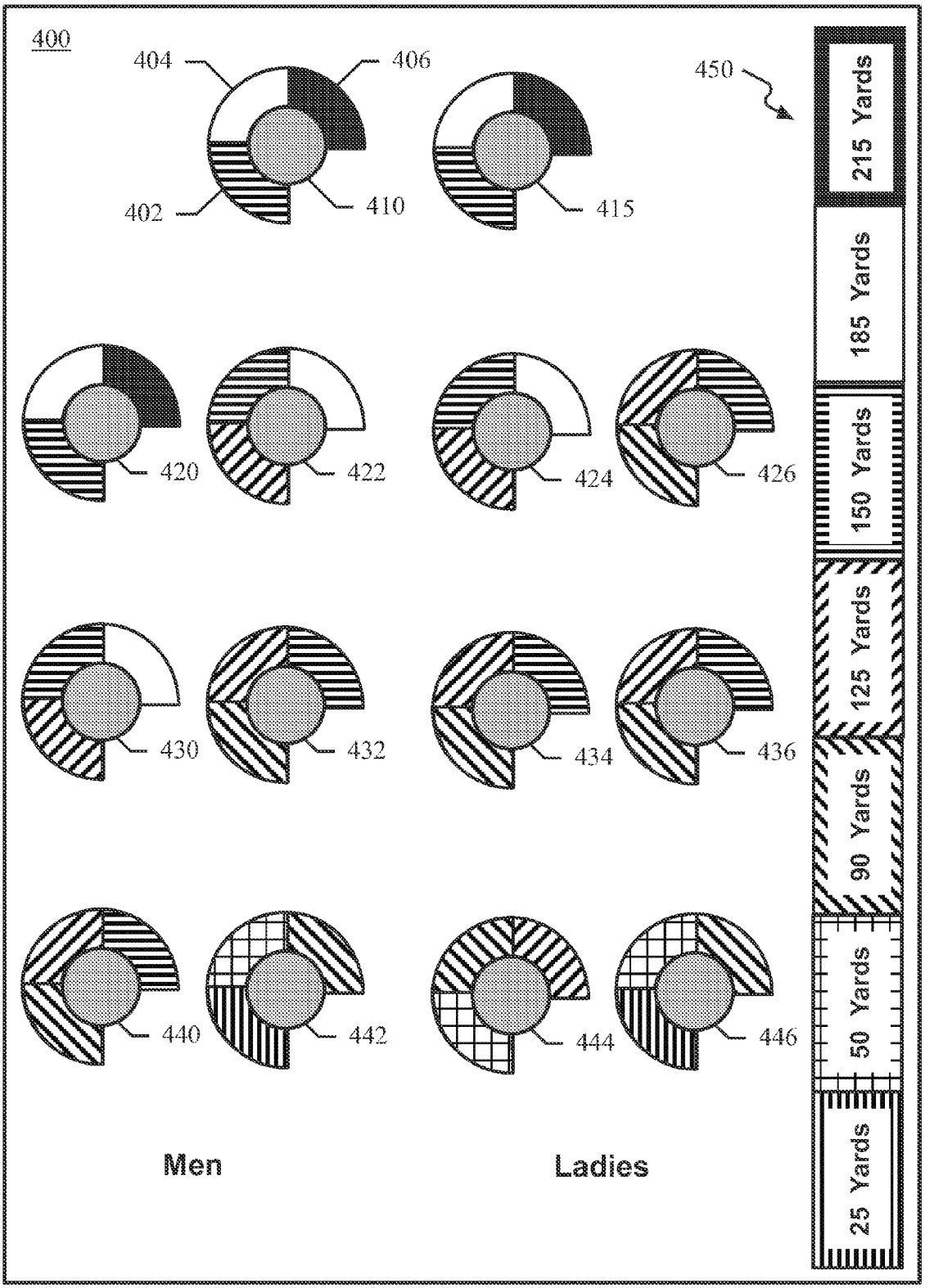
FIG. 4 shows an example of a panel for holders of a golf club stand, including visual indicators and a corresponding ranging chart.

FIG. 4 shows an example of a panel 400 for holders 410-446 of a golf club stand, including visual indicators and a corresponding ranging chart 450. The ranging chart 450 can have seven discrete sections, each including a color corresponding to a target and a distance value corresponding to both. In the example shown, red is labeled 25 yards, yellow is labeled 50 yards, green is labeled 90 yards, brown is labeled 125 yards, blue is labeled 150 yards, white is labeled 185 yards, and black is labeled 215 yards. Other color and distance value combinations are of course possible. Moreover, other placements of the holders are also possible.

The holders 410-446 can be split between a men portion for holders 410, 420, 422, 430, 432, 440, 442, and a ladies portion for holders 415, 424, 426, 434, 436, 444, 446. Each of the holders 410-446 can have a single club held therein and can have three associated colors. For example, the holder 410 can be for a driver and can include visual indicators 402, 404, 406 corresponding to blue (for a target placed around 150 yards out), white (for a target placed around 185 yards out), and black (for a target placed around 215 yards out). Thus, this arrangement quickly identifies an appropriate club to grab for any given target. As described further below, there is overlap among the identified clubs for the specific targets. This is because different people are able to hit golf balls different distances with different types of clubs. Thus, there is not necessarily a one-to-one correspondence for a given target and a given type of club. In some implementations, the correspondence between holders, clubs and targets are as shown in Table 1 below (referencing the targets of FIG. 1, and the holders of FIG. 4):

TABLE 1

| Targets (Colors) | Club | Holder |
|---|---|---|
| 180 (Black), 170 (White), 160 (Blue) | Driver | 410 |
| 180 (Black), 170 (White), 160 (Blue) | Driver | 415 |
| 180 (Black), 170 (White), 160 (Blue) | 3 Wood | 420 |
| 170 (White), 160 (Blue), 150 (Brown) | 3 Hybrid | 422 |
| 170 (White), 160 (Blue), 150 (Brown) | 3 Wood | 424 |
| 160 (Blue), 150 (Brown), 140 (Green) | 3 Hybrid | 426 |
| 170 (White), 160 (Blue), 150 (Brown) | 4 Iron | 430 |
| 160 (Blue), 150 (Brown), 140 (Green) | 6 Iron | 432 |
| 160 (Blue), 150 (Brown), 140 (Green) | 4 Iron | 434 |
| 160 (Blue), 150 (Brown), 140 (Green) | 6 Iron | 436 |
| 160 (Blue), 150 (Brown), 140 (Green) | 8 Iron | 440 |
| 140 (Green), 130 (Yellow), 120 (Red) | Putting Wedge | 442 |
| 150 (Brown), 140 (Green), 130 (Yellow) | 8 Iron | 444 |
| 140 (Green), 130 (Yellow), 120 (Red) | Putting Wedge | 446 |

Note that the panel 400 can include labels for the club types written on the panel itself in the location where the reference numbers are shown on the figures.

In some implementations, the correspondence between holders, clubs and targets are as shown in Table 2 below (referencing the targets of FIG. 1, and the holders of FIG. 4):

TABLE 2

| Targets (Colors) | Club | Holder |
|---|---|---|
| 180 (Black), 170 (White), 160 (Blue) | Driver | 410 |
| 180 (Black), 170 (White), 160 (Blue) | Driver | 415 |
| 180 (Black), 170 (White), 160 (Blue) | 3 Wood | 420 |
| 170 (White), 160 (Blue), 150 (Brown) | 3 Hybrid | 422 |
| 170 (White), 160 (Blue), 150 (Brown) | 3 Wood | 424 |
| 160 (Blue), 150 (Brown), 140 (Green) | 3 Hybrid | 426 |
| 170 (White), 160 (Blue), 150 (Brown) | 5 Iron | 430 |
| 160 (Blue), 150 (Brown), 140 (Green) | 7 Iron | 432 |
| 160 (Blue), 150 (Brown), 140 (Green) | 5 Iron | 434 |
| 160 (Blue), 150 (Brown), 140 (Green) | 7 Iron | 436 |
| 160 (Blue), 150 (Brown), 140 (Green) | 9 Iron | 440 |
| 140 (Green), 130 (Yellow), 120 (Red) | Sand Wedge | 442 |
| 150 (Brown), 140 (Green), 130 (Yellow) | 9 Iron | 444 |
| 140 (Green), 130 (Yellow), 120 (Red) | Sand Wedge | 446 |

In some implementations, the odd and even irons can be alternated in the golf club stand 300. Thus, one side of the golf club stand 300 can use correspondence between holders, clubs and targets as shown in Table 1, while the other side of the same golf club stand 300 can use correspondence between holders, clubs and targets as shown in Table 2.

The examples of Tables 1 & 2 include seven holders for clubs for men and seven holders for clubs for women, as shown in FIG. 4. In other words, a reduced set of golf clubs is provided as loaners for players who do not have their own set of clubs. This further simplifies the selection of a club by a person entirely new to the game of golf and can reduce costs for the golfing site, both in terms of initial set up and maintenance over time. Other arrangements are also possible, including different numbers of clubs and different numbers of holders. For example, the golf club stand 300 can include eleven holders for clubs for men and eleven holders for clubs for women. In these implementations, the correspondence between holders, clubs and targets can be as shown in Table 3 below (referencing the targets of FIG. 1):

TABLE 3

| Targets (Colors) | Club | Holder |
|---|---|---|
| 180 (Black), 170 (White), 160 (Blue) | Driver | Men 1 |
| 180 (Black), 170 (White), 160 (Blue) | Driver | Ladies 1 |
| 180 (Black), 170 (White), 160 (Blue) | 3 Wood | Men 2 |
| 170 (White), 160 (Blue), 150 (Brown) | 3 Wood | Ladies 2 |
| 170 (White), 160 (Blue), 150 (Brown) | 3 Hybrid | Men 3 |
| 160 (Blue), 150 (Brown), 140 (Green) | 3 Hybrid | Ladies 3 |
| 170 (White), 160 (Blue), 150 (Brown) | 4 Iron | Men 4 |
| 160 (Blue), 150 (Brown), 140 (Green) | 4 Iron | Ladies 4 |
| 170 (White), 160 (Blue), 150 (Brown) | 5 Iron | Men 5 |
| 160 (Blue), 150 (Brown), 140 (Green) | 5 Iron | Ladies 5 |
| 160 (Blue), 150 (Brown), 140 (Green) | 6 Iron | Men 6 |
| 160 (Blue), 150 (Brown), 140 (Green) | 6 Iron | Ladies 6 |
| 160 (Blue), 150 (Brown), 140 (Green) | 7 Iron | Men 7 |
| 160 (Blue), 150 (Brown), 140 (Green) | 7 Iron | Ladies 7 |
| 160 (Blue), 150 (Brown), 140 (Green) | 8 Iron | Men 8 |
| 150 (Brown), 140 (Green), 130 (Yellow) | 8 Iron | Ladies 8 |
| 160 (Blue), 150 (Brown), 140 (Green) | 9 Iron | Men 9 |
| 150 (Brown), 140 (Green), 130 (Yellow) | 9 Iron | Ladies 9 |
| 140 (Green), 130 (Yellow), 120 (Red) | Putting Wedge | Men 10 |
| 140 (Green), 130 (Yellow), 120 (Red) | Putting Wedge | Ladies 10 |
| 140 (Green), 130 (Yellow), 120 (Red) | Sand Wedge | Men 11 |
| 140 (Green), 130 (Yellow), 120 (Red) | Sand Wedge | Ladies 11 |

In general, the distance assignments can be adapted to accommodate a given target layout to provide a guideline for beginner golfers. As will be appreciated, some first time golfers will hit the ball farther than indicated by the guide, and other first time golfers may hit the ball shorter than indicated by the guide.

Figure 5:
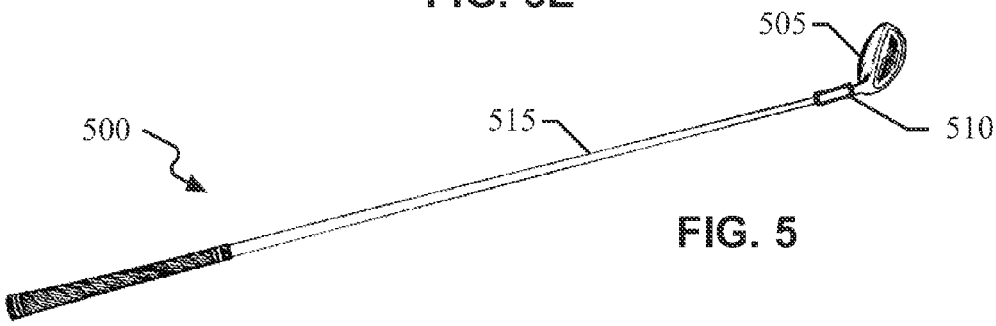
FIG. 5 shows an example of a golf club.

In addition, other implementations can include more than one club in each holder of the golf club stand 300. Furthermore, in some implementations, the golf clubs provided as loaner clubs can be configured to be more durable than golf clubs sold at retail outlets. At a minimum, such durability configuration can be applied to the clubs other than irons and wedges. For example, FIG. 5 shows an example of a golf club 500, the head 505 of the club 500 has been made using steel (e.g., for hybrid) or titanium (e.g., for driver and 3-wood) walls that are thicker than typical golf clubs and also given a tumbled finish rather than be painted. This can help prevent damage to the head that might otherwise result from use by novice golfers, and also reduce the cost of refinishing the club head 505 as it becomes worn over time. Further, the hozzle 510 can be made longer than a standard club, which can reduce the wear and damage over time caused by novice gofers who often fail to hit the ball with the head itself. In addition, the shaft 515 of the club can be made of fiberglass to farther increase durability without adding extra weight to the club. In general, the leaner clubs should be built of structures that increase their durability, even if such structures would make them less desirable should one attempt to sell them at retail prices to experienced golfers. This can reduce the costs of maintaining the leaner club system, both in terms of the cost of replacement for clubs as they become damaged, and in terms of the risks of theft.

While this disclosure contains many specific implementation details, these should not be construed as limitations on the scope of any inventions or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. For example, the specific selections of club types and visual indicators can be changed, depending on various factors, including the number and distances of the targets used a specific golfing site, and the nature of the general public at a particular location, which can impact the types of clubs that are appropriate for the average person likely to arrive at the bay at the golfing site.

What is claimed is:

1. The system comprising:

a golf ball hitting bay;

a golf range in front of the bay, the range including targets having different distances from the bay, each of the different targets having an associated identifier;

a device included in the bay, wherein the device delivers golf balls retrieved from the different targets; and a golf club stand associated with the bay, wherein the golf club stand holds clubs of different types and includes visual indicators corresponding to the different targets;

wherein the golf club stand comprises discrete portions for the different types of golf clubs, each of the discrete portions has only one holder that is able to hold one or more clubs, and each of the discrete portions has more than one of the visual indicators associated therewith.

2. The system of claim 1, wherein the golf range includes additional targets having similar distances from the bay as the targets having different distances from the bay.

3. The system of claim 1, wherein the different targets comprise circular targets.

4. The system of claim 1, wherein the identifiers associated with the different targets are colors, and the visual indicators are colors that match the colors associated with the different targets.

5. The system of claim 4, wherein the golf club stand comprises a panel including discrete sections, each of the discrete sections including a color and a distance value corresponding to one of the different targets.

6. The system of claim 5, wherein the discrete portions for the different types of golf clubs comprise holes in the panel.

7. The system of 6, wherein each of the holes has three different colors associated therewith and is in either a men portion or a ladies portion of the panel.

8. A system comprising:

a golf ball hitting bay;

a golf range in front of the bay, the range including targets having different distances from the bay, each of the different targets having an associated identifier;

a device included in the bay, wherein the device delivers golf balls retrieved from the different targets; and a golf club stand associated with the bay, wherein the golf club stand holds clubs of different types and includes visual indicators corresponding to the different targets;

wherein the golf club stand comprises discrete portions for the different types of golf clubs, and each of the discrete portions has more than one of the visual indicators associated therewith; and wherein the golf club stand comprises a first portion and a second portion, the first portion includes the discrete portions for the different types of golf clubs, and the second portion includes openings for golf club bags.

9. The system of claim 8, wherein the golf ball hitting bay is a first bay that includes at least part of the golf club stand, the system comprises a second bay that includes at least part of the golf club stand, the golf club stand has two sides, each of the sides holding clubs and including visual indicators corresponding to the different targets, and the first and second bays share the golf club stand.

10. The system of claim 8, wherein the second portion comprises an angled base and a stop for each of the openings for golf club bags.

11. The system of claim 8, comprising the clubs of different types, wherein at least the clubs other than irons and wedges are configured to be more durable than golf clubs sold at retail outlets.

* * * * *

UNITED STATES PATENT AND TRADEMARK OFFICE

CERTIFICATE OF CORRECTION

PATENT NO. : 9,132,326 B2
APPLICATION NO. : 13/831084
DATED : September 15, 2015
INVENTOR(S) : Mark Caster et al.

It is certified that error appears in the above-identified patent and that said Letters Patent is hereby corrected as shown below:

In the Claims

Column 9, line 19, in Claim 1, delete "The" and insert -- A -- therefor.

Column 10, line 7, in Claim 7, delete "system of" and insert -- system of claim -- therefor.

Signed and Sealed this
Twenty-eighth Day of June, 2016

Michelle K. Lee

Michelle K. Lee
*Director of the United States Patent and Trademark Office*